US007798068B2

(12) United States Patent
Nishihara et al.

(10) Patent No.: US 7,798,068 B2
(45) Date of Patent: Sep. 21, 2010

(54) FRICTION DRIVE TROLLEY CONVEYOR

(75) Inventors: Shigeyoshi Nishihara, Shiga (JP); Toshiyuki Iba, Osaka (JP)

(73) Assignee: Daifuku Co., Ltd (JP)

( * ) Notice: Subject to any disclaimer, the term of this patent is extended or adjusted under 35 U.S.C. 154(b) by 55 days.

(21) Appl. No.: 12/360,264

(22) Filed: Jan. 27, 2009

(65) Prior Publication Data

US 2009/0193998 A1 Aug. 6, 2009

(30) Foreign Application Priority Data

Feb. 5, 2008 (JP) ..... 2008-024689

(51) Int. Cl.
*B61J 3/04* (2006.01)

(52) U.S. Cl. ..... 104/172.4; 104/89; 104/93; 104/94; 104/95; 105/30; 105/32; 105/148; 105/150; 105/154

(58) Field of Classification Search ..... 104/172.4, 104/89, 93, 94, 95; 105/30, 32, 33, 148, 105/150, 154, 155

See application file for complete search history.

(56) References Cited

U.S. PATENT DOCUMENTS 3,724,391 A * 4/1973 Velde ..... 104/172.4
3,827,367 A * 8/1974 Paglia ..... 104/93
3,999,730 A * 12/1976 Gonsalves et al. ..... 246/434
4,148,261 A * 4/1979 Wakabayashi ..... 104/172.4
4,532,385 A * 7/1985 Friske ..... 191/23 A
4,646,650 A * 3/1987 Kondo et al. ..... 104/172.3
4,669,388 A * 6/1987 Dehne et al. ..... 104/162
4,745,865 A * 5/1988 Dehne ..... 104/172.3
4,924,996 A * 5/1990 Svensson et al. ..... 198/341.05
5,235,917 A * 8/1993 Luck et al. ..... 104/119
5,340,249 A * 8/1994 Nakamura ..... 410/78
5,450,796 A * 9/1995 Sakagami ..... 104/89
5,505,290 A * 4/1996 Fujii et al. ..... 198/345.1
5,632,207 A * 5/1997 Roberts et al. ..... 104/288
6,192,803 B1 * 2/2001 Nishino ..... 104/93
6,196,372 B1 * 3/2001 Rossi ..... 198/345.1
6,360,671 B1 * 3/2002 Nakagami ..... 104/168
6,695,126 B2 * 2/2004 Minamikawa ..... 198/680
7,089,868 B2 * 8/2006 Kawato et al. ..... 104/103

(Continued)

FOREIGN PATENT DOCUMENTS

JP 2004-025904 1/2004

*Primary Examiner*—Mark T Le
*Assistant Examiner*—Jason C Smith
(74) *Attorney, Agent, or Firm*—St. Onge Steward Johnston & Reens LLC

(57) ABSTRACT

A friction drive trolley conveyor has a conveying traveling body provided with a friction drive load bar having traction purpose engaging means at both ends thereof and allows traction drive to be easily conducted without fail even at the time of conveying a heavy object. The traction purpose engaging means is composed of an engaged shaft arranged in the horizontal direction within a vertical notched portion formed at one end of the load bar, a hook member vertically swingably pivotally supported at an intermediate position in vertical height of the load bar at the other end of the load bar and a holding means holding the hook member in an engaged posture or a disengaged posture, and on a traveling route side, a first switching means switching the hook member from the engaged posture to the disengaged posture and a second switching means switching the hook member from the disengaged posture to the engaged posture.

8 Claims, 12 Drawing Sheets

U.S. PATENT DOCUMENTS

| | | | | |
|---|---|---|---|---|
| 7,201,105 | B2 * | 4/2007 | Nishihara et al. | 104/172.3 |
| 7,225,914 | B2 * | 6/2007 | Nakamura et al. | 198/465.4 |
| 7,296,521 | B2 * | 11/2007 | Kawato et al. | 104/103 |
| 7,461,735 | B2 * | 12/2008 | Nakamura | 198/465.4 |
| 7,484,616 | B2 * | 2/2009 | Nakamura | 198/465.4 |
| 7,650,843 | B2 * | 1/2010 | Minges | 104/178 |
| 2004/0011239 | A1 * | 1/2004 | Kawato et al. | 104/172.4 |
| 2004/0261648 | A1 * | 12/2004 | Nishihara et al. | 104/163 |
| 2005/0183620 | A1 * | 8/2005 | Kawato et al. | 104/89 |
| 2006/0266253 | A1 * | 11/2006 | Kawato et al. | 104/172.1 |
| 2007/0289845 | A1 * | 12/2007 | Takano et al. | 198/465.4 |
| 2008/0148992 | A1 * | 6/2008 | Bambrick et al. | 105/30 |
| 2009/0193998 | A1 * | 8/2009 | Nishihara et al. | 104/91 |
| 2009/0205532 | A1 * | 8/2009 | Nishihara et al. | 105/149 |

* cited by examiner (A)

(B)

FRICTION DRIVE TROLLEY CONVEYOR

FIELD OF THE INVENTION

The present invention relates to a friction-drive trolley conveyor using a conveying traveling body composed of a plurality of trolleys and a load bar for friction drive which is suspended on the trolleys and joins the trolleys together.

DESCRIPTION OF THE RELATED ART AND ITS PROBLEMS

Friction drive trolley conveyors of this kind are used as a means for suspendingly conveying a large long object such as vehicle body. As described in Japanese Unexamined Patent Application Publication No. 2004-25904 (hereinafter, referred to as Patent Document 1), the friction drive trolley conveyors include conveying traveling bodies and object supports (hangers) suspended from the conveying traveling bodies wherein each conveying traveling body includes, for example, four trolleys arranged in series in a traveling direction and a load bar composed of a plurality of load bar units which are suspended by the trolleys and joined via bent joint portions concentric to a vertical axis center of rotation of respective trolleys, and a friction drive means including a friction drive wheel which pressure-contacts with a side surface of the load bar and is rotation-driven is arranged on a traveling route side. The one described in the Patent Document is configured such that each conveying traveling body can be propelled in such a traction drive system that a rear side conveying traveling body joined via a joining means provided at both of the front and rear ends of the load bar of each conveying traveling body is pulled by a front side conveying traveling body driven by the friction drive means. However, as described in the Patent Document 1, this kind of conventional friction drive trolley conveyor has been configured such that the joining means joining the front and the rear conveying traveling body together is composed of an engaged shaft provided at a lower side of one end of the load bar and a vertically swingable hook member provided at a lower side of the other end of the load bar.

In the configuration as described in the Patent Document, a joining section between the front and rear conveying traveling bodies by the joining means is a position away to the lower side at the end portions of the load bar. Thus, when the rear side conveying traveling body joined by such joining means is pulled by the front side conveying traveling body, a large bending force will be acted upon a bracket projectingly provided downward from one end of the load bar in order to support the engaged shaft constituting the joining means or a bracket projectingly provided downward from the other end of the load bar in order to pivotally support the hook member, and accordingly the conveyor has not been usable as a trolley conveyor conveying a heavy vehicle body and the like. Further, unlike a carriage type, the load bar of the trolley conveyor is a relatively thin rod suspended by a plurality of trolleys and provided with a horizontally bent joint portion on the middle thereof. There is a concern that the bracket is sufficiently reinforced to increase bending rigidity, a bending deformation could be caused at an end region of the load bar itself.

DETAILED DESCRIPTION OF THE INVENTION

It is an object of the present invention to provide a friction drive trolley conveyor capable of solving the above-described conventional problems. A friction drive trolley conveyor described in a first aspect, as indicated by giving reference numerals of embodiments described later, is configured to include conveying traveling bodies 1 and object supports (hangers) 6 suspended on the conveying traveling bodies 1, each conveying traveling body 1 composed of a load trolley 3*a*, 3*b* supporting an object, a free trolley 4*a*, 4*b* located at least at either one of the front or rear (at both front and rear sides in the embodiments) of the load trolley 3*a*, 3*b* and a load bar 5 with both end portions which is suspended by the trolleys 3*a* to 4*b* and joins the trolleys 3*a* to 4*b* together, the both end portions of the load bar 5 provided with traction purpose engaging means 32, 50 which are engagably and disengagably engaged with each other in a state where the rear end of the load bar 5 of a front side conveying traveling body 1 and the front end of the load bar 5 of a rear side conveying traveling body 1 are close to each other, and a traveling route side provided with a friction drive means 13 including a friction drive wheel 14 which pressure-contacts with a side surface of the load bar 5 and is rotation-driven, whereby a conveying traveling body 1 propelled by the friction drive means 13 can traction-drive a following conveying traveling body 1 joined via the traction purpose engaging means 32, 50 of each conveying traveling body 1, wherein the traction purpose engaging means 32, 50 includes a vertical notched portion 44, 62 formed on one end of the load bar 5, an engaged shaft 35, 53 arranged in the horizontal direction within the notched depression portion 44, 62 so as to locate at an intermediate position in vertical height of the load bar 5, a hook member 33, 51 vertically swingably pivotally supported at the other end of the load bar 5 at the intermediate position in vertical height of the load bar 5 and being engagable and disengagable with the engaged shaft 35, 53 of the load bar 5 of an adjacent conveying traveling body 1, and a holding means holding the hook member 33, 51 in an engaged posture or a disengaged posture in an alternative way, and the traveling route side is provided with a first switching means 45, 65 switching the hook member 33, 51 from the engaged posture to the disengaged posture and a second switching means 47, 63 switching the hook member 33, 51 from the disengaged posture to the engaged posture.

According to the above configured friction drive trolley conveyor of the present invention, when the friction-driven front side conveying traveling body traction-drives the rear side conveying traveling body via the traction purpose engaging means provided at the front and rear end portions of the load bar, the engaged shaft of one of the traction purpose engaging means and a pivotal support position of the hook member of the other to be engaged with the engaged shaft are both at the intermediate position in vertical height of the load bar. Thus, the engaged shaft can be supported on the load bar directly and the hook member can pivotally be supported on the load bar directly. Accordingly, it becomes unnecessary to projectingly provide a bracket at a lower side of an end of the load bar as conventionally, whereupon componentry can be reduced and costs can be cut. Further, there is no engaged shaft supporting bracket or hook member pivotally supporting bracket which is subjected to bending force during traction drive. Thus, the traction drive can be conducted safely without fail even when a large traction force is required. The friction drive trolley conveyor can also be used as a trolley conveyor for conveying a heavy vehicle body or the like. Furthermore, the bending force does not come to indirectly act upon the distal end portion of the load bar, so that there is no need to make the load bar itself thicker to improve bending rigidity. Thus, lighter weight of the conveying traveling body and in its turn downsizing of the friction drive means can be promoted.

On the other hand, when the hook member is switched between the engaged posture and the disengaged posture by directly acting the first switching means and the second switching means upon the hook member, a hook member operated direction by the first switching means and a hook member operated direction by the second switching means become opposite. Either one of the first and second switching means will have a switching operation with slight difficulties in connection with the traveling direction of the conveying traveling body. In order to solve the problem, a configuration described in a second aspect is proposed.

More specifically, as described in the second aspect, the present invention can be configured such that the hook member 33 is urgedly held in the engaged posture, the holding means of the traction purpose engaging means 32 is provided with a locking member 34 which holds the hook member 33 having been switched from the engaged posture to the disengaged posture by the first switching means 45 in the disengaged posture, the locking member 34 is urgedly held in the operated posture of holding the hook member 33 in the disengaged posture, and the second switching means 47 switches the locking member 34 from the operated posture to a non-operated posture.

According to the configuration described in the second aspect, a locking member which holds the hook member having been switched into the disengaged posture in the disengaged posture is provided in addition to the hook member. The hook member is configured to be switched into the engaged posture by the urging force by switching the locking member into the non-operated posture. As a result, the switching of the hook member into the engaged posture by the second switching means can be performed with ease and certainty.

When the configuration described in the second aspect is adopted, it can be configured as described in a third aspect that the hook member 33 is urgedly held in the engaged posture by the plumb bob portion 38 extending from the pivotal support position and is provided with a switching purpose operated portion 39 protruding to one of the left and right sides at the lower side of the load bar 5, and the locking member 34 is vertically swingably pivotally supported at the lower side of the load bar 5 and includes a distal nail portion 41 fitting into between the hook member 33 and the load bar 5 to hold the hook member 33 in the disengaged posture only when the hook member is in the disengaged posture, a plumb bob portion 42 extending from the pivotal support position of the locking member 34 to the opposite side of the distal nail portion 41 side and a switching purpose operated portion 43 protruding to the other of the left and right sides at the lower side of the load bar 5. The first switching means 45 can be composed of a cam rail 46 acting upon the switching purpose operated portion 39 of the hook member 33 and the second switching means 47 can be composed of a cam rail 48 acting upon the switching purpose operated portion 43 of the locking member 34.

According to the configuration described in the third aspect, the present invention can be configured without use of any spring at all and also without providing any protrusions at an upper side of the load bar. Furthermore, both of the first and the second switching means can readily be constituted by cam rails requiring no actuator, and accordingly carrying out the configuration described in the second aspect becomes easy. On the other hand, a combined use of the plumb bob portion 42 and spring is possible.

Further, as described in a fourth aspect, the holding means of the hook member 51 can be constituted by two engaged depressions 57, 58 provided around the pivotal support position of the hook member 51 and a spring-urged lock member 52 fitting to one of the two engaged depression portions 57, 58 when the hook member 51 is in the engaged posture and fitting to the other of the two engaged depression portions 57, 58 when the hook member 51 is in the disengaged posture. In this case, as described in a fifth aspect, the hook member 51 is provided with a switching purpose operated portion 56 protruding in the lateral direction at the lower side of the load bar 5, and the first switching means 65 and the second switching means 63 can be composed of cam rails 64, 66 acting upon the switching purpose operated portion 56.

According to the configuration described in the fourth aspect, the locking member becomes unnecessary, so that the configuration can be simplified, as compared with the configuration described in the second aspect. Further, according to the configuration described in the fifth aspect, both of the first and second switching means can readily be composed of cam rails requiring no actuator, so that carrying out the configuration described in the fourth aspect becomes easy.

Further, as described in a sixth aspect, the load bars 5 of the front and rear conveying traveling bodies 1 can be configured such that end surfaces thereof abut against each other when the hook member 33, 51 is in the disengaged posture. The configuration described in the sixth aspect can be carried out in combination with any one of the configurations described in the first to fifth aspects.

According to the configuration described in the sixth aspect, the front side conveying traveling body can be thrust-driven by the rear side conveying traveling body via respective load bars as long as the hook member is switched into the disengaged posture. At this moment, excessive force need not be acted upon the traction purpose engaging means at the front and rear end portions of the load bars. Consequently, a possibility that normal traction drive becomes unavailable due to deformation of the traction purpose engaging means or a possibility that a useful life of the traction purpose engaging means is shortened is prevented.

Further, as described in a seventh aspect, the front and rear end surfaces 55*c*, 55*d* of the load bar 5 can be formed into such a shape that a clearance produced between the load bars 5 of the front and rear conveying traveling bodies 1 when the rear side conveying traveling body 1 is traction-driven by the front side conveying traveling body 1 via the traction purpose engaging means 32, 50 does not penetrate in the vertical direction in plan view. In this case, as described in an eighth aspect, the front and rear end surfaces 55*c*, 55*d* of the load bar 5 are preferably formed into an inclined plane slanting in the same direction. On the other hand, the configuration described in the seventh aspect can be carried out in combination with any one of the configurations described in the first to sixth aspects.

According to the seventh aspect, the friction drive wheel can shift smoothly from the front side load bar to the rear side load bar in the traction drive state at all times, and the traction drive by the traction purpose engaging means can be conducted well without fail. In this case, according to the configuration described in the eighth aspect, a length of the front and rear end portions of the load bar extending further forward and rearward than the support shaft of the hook member and engaged shaft of the traction purpose engaging means provided at the front and rear end portions of the load bar can be shortened, and the thrust-drive using the load bars at the horizontal curved route section can also be conducted without any problem.

DESCRIPTION OF REFERENCE NUMERALS

Figure 1:
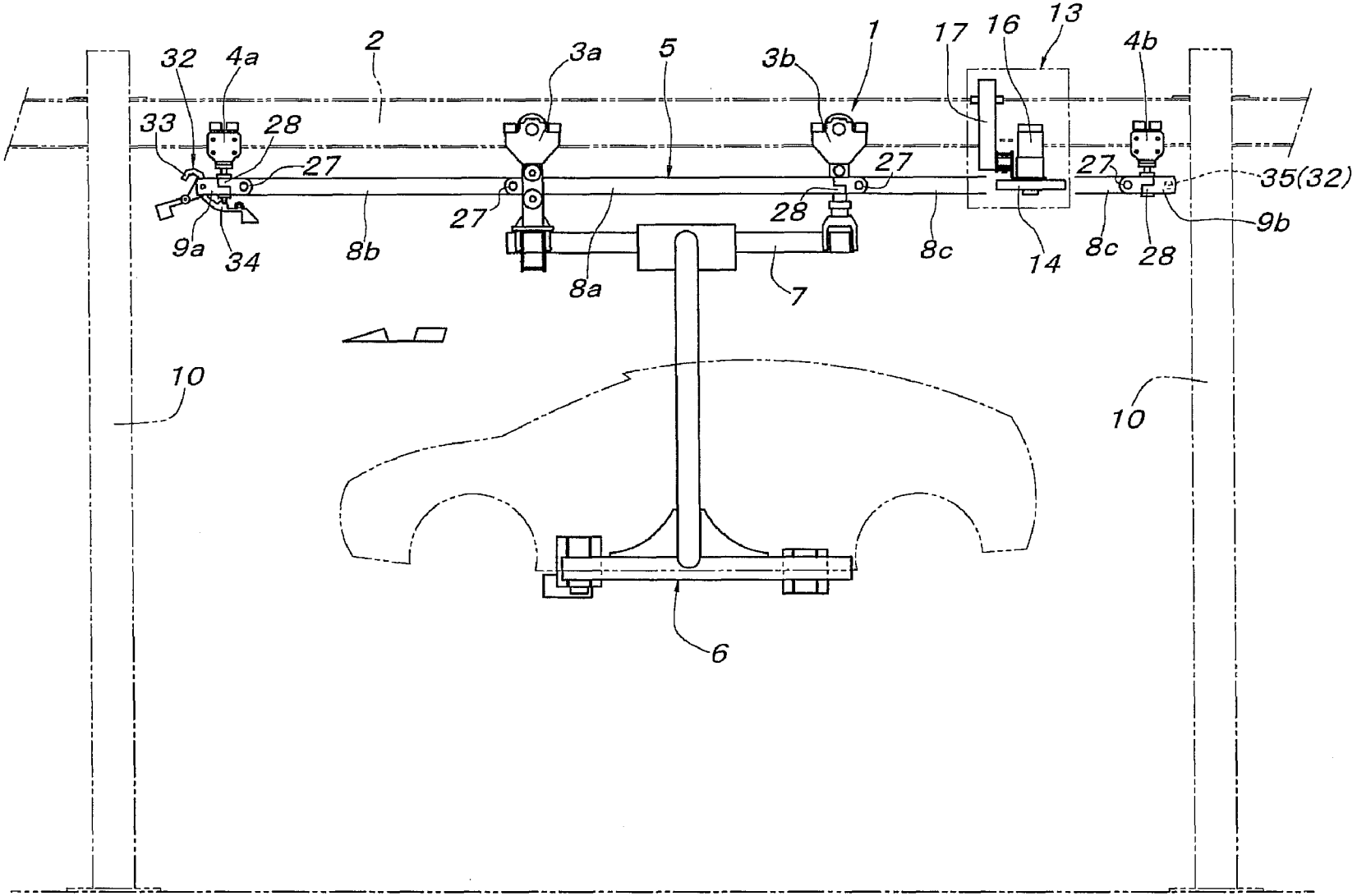
FIG. 1 is a side view showing a conveying traveling body and a friction drive means on a traveling route.

1: conveying traveling body
2: guide rail
3*a*, 3*b*: load trolley
4*a*, 4*b*: free trolley
5: load bar
6: hanger (object support tool)
8*a*-8*c*: intermediate load bar unit
9*a*, 9*b*: front/rear end load bar unit
10: portal frame
13: friction drive means
14: friction drive wheel
15: backup roller
16: motor
23: vertical axis roller of free trolley
24: vertical axis of free trolley
27: vertically bent joint portion
28: horizontally bent joint portion
30: hanger suspending bracket
32, 50: traction purpose engaging means
33, 51: hook member
33*a*, 51*a*: distal upright portion of hook member
33*b*, 51*b*: downward extending portion of hook member
34: locking member
35, 53: engaged shaft
36, 44, 54, 62: notched depression portion
37, 55: support shaft of hook member
38, 42: plumb bob portion
39, 43, 56: switching purpose operated portion (cam follower roller)
41: distal nail portion of locking member
45, 65: first switching means
46, 48, 64, 66: cam rail
47, 63: second switching means
52: spring-urged lock member
55*c*, 55*d*: front/rear end surface of load bar
57, 58: engaged depression
60: compression coil spring

Preferred Embodiments of the Present Invention

Figure 2:
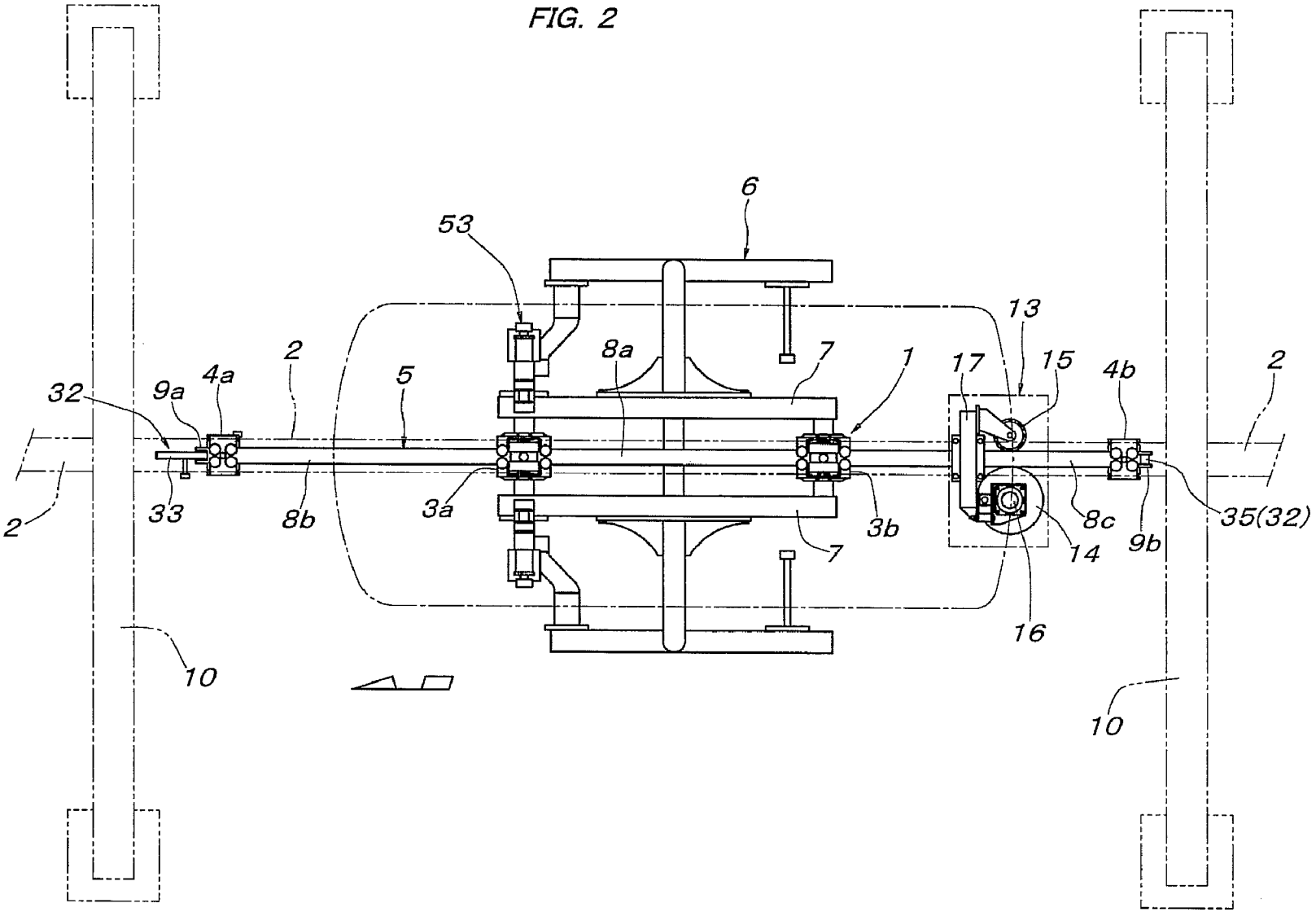
FIG. 2 is a plan view showing the same.
Figure 3:
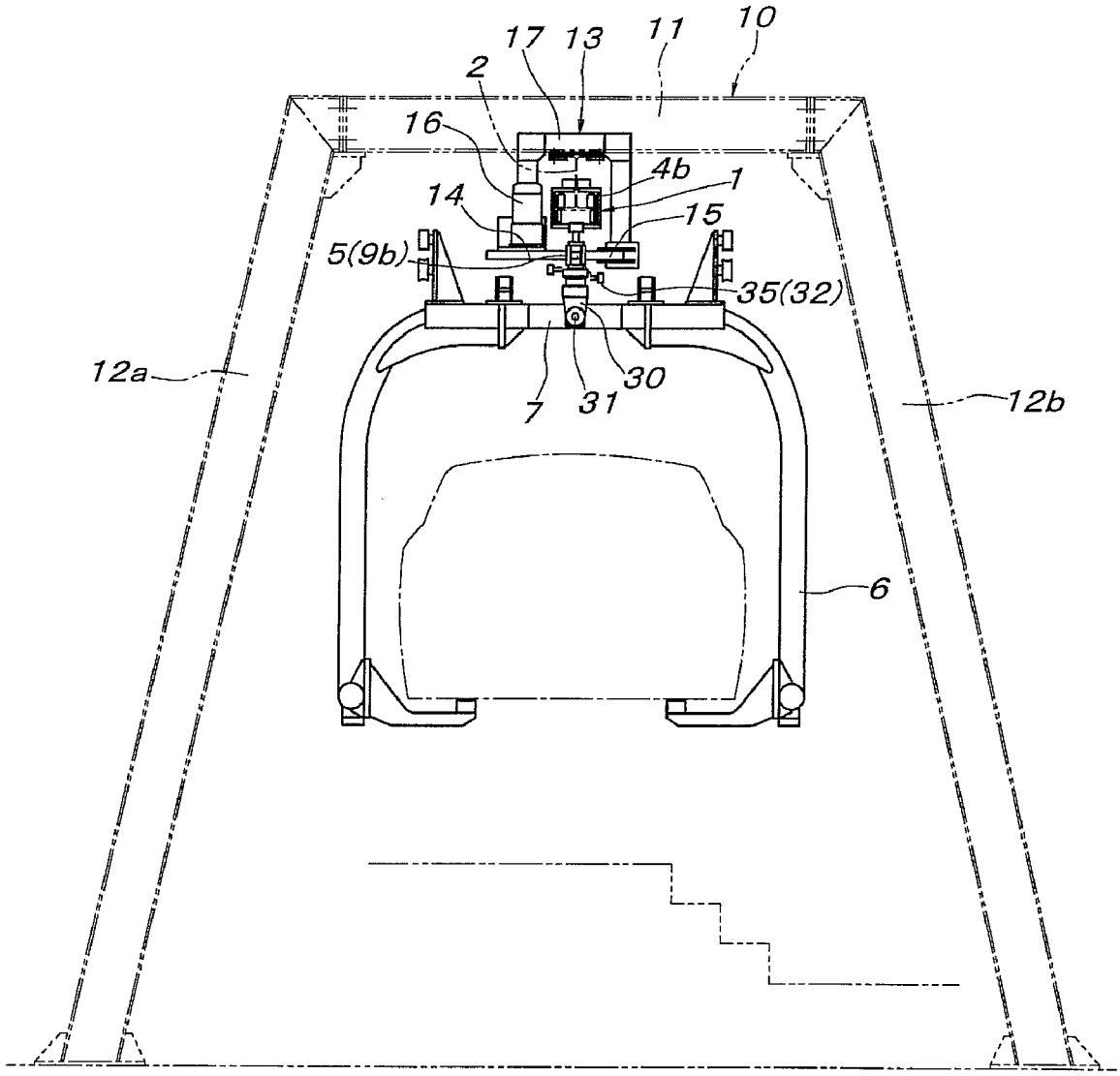
FIG. 3 is a rear view showing the same.

Hereinafter, specific embodiments of the present invention are described based on the accompanying drawings. In FIGS. 1 to 3, reference numeral 1 is a conveying traveling body composed of four trolleys, that is, a pair of front and rear load trolleys 3*a*, 3*b* on the middle and a front and a rear end free trolley 4*a*, 4*b*, travelably engaged with a guide rail 2 horizontally built at a predetermined height above the floor, a load bar 5 suspended by the four trolleys 3*a* to 4*b* and a hanger 6 as an object support tool. The load bar 5 is composed of three intermediate load bar units 8*a* to 8*c* joining the four trolleys 3*a* to 4*b* respectively and short front and rear end load bar units 9*a*, 9*b* coupled to the front and rear end free trolleys 4*a*, 4*b* and slightly protruding forward and rearward from the front and rear end free trolleys 4*a*, 4*b*.

On a traveling route for the conveying traveling body 1 constituted by the guide rail 2, portal frames 10 are mounted on the floor at appropriate intervals in a longitudinal direction of the traveling route. The guide rail 2 is fixed and suspended on the center at a lower side of an upper end rail suspension frame portion 11 of the portal frame 10. As the portal frame, exemplified is one wherein a pair of left and right strut frame portions 12*a*, 12*b* supporting both ends of the horizontal rail suspension frame portion 10 has a flared trapezoidal shape. However, the portal frame 10 may be of a perpendicular inverted U-shape with the pair of left and right strut frame portions 12*a*, 12*b* being parallel or may be of a curved arch shape in its entirety. Further, portal frames 10 can be joined with each other by a joining frame other than the guide rail 2, and the joining frame can be provided with a mount for maintenance work which a worker can get on, if necessary.

Figure 6:
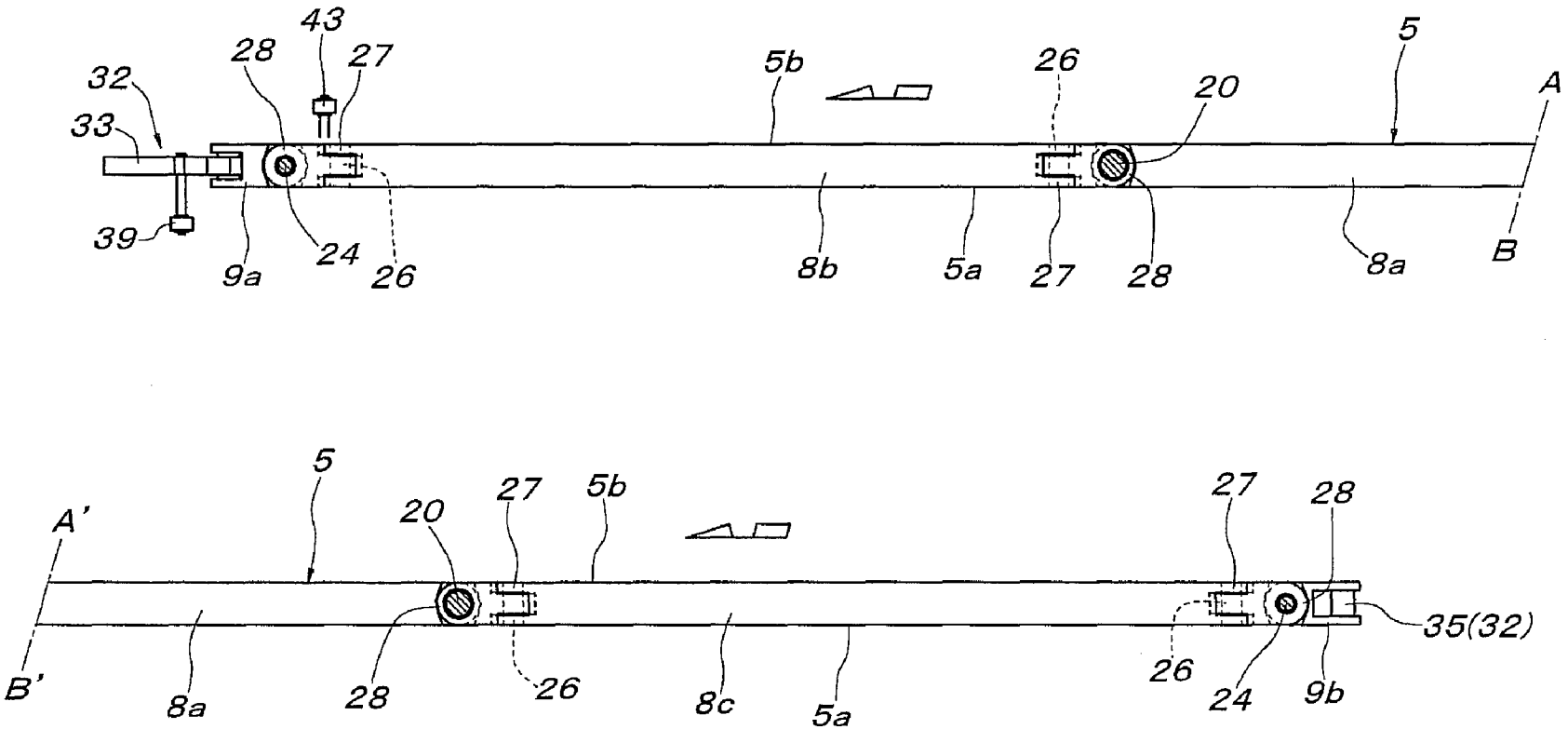
FIG. 6 is a plane view showing a load bar of the conveying traveling body linked by the line A-B and the line A'-B'.

Friction drive means 13 are provided to the guide rail 2 at appropriate intervals. The friction drive means 13 are conventionally well known and constituted by a friction drive wheel 14 pressure-contacting with one side surface 5*a* of left and right vertical side surface 5*a*, 5*b* of the load bar 5 (see FIG. 6), a backup roller abutting against the other side surface 5*b* and a motor 16 rotation-driving the friction drive wheel 14. The backup roller 15 is only rotatably pivotally supported by a vertical support shaft at a fixed position of a frame 17 fixed with the guide rail 2. The motor 16 in which the friction drive wheel 14 is attached to a vertical output shaft is supported on the frame 17 horizontally movable relative to the side surface 5*a* of the load bar 5 and also urged by a spring to the pressure-contacting direction with the side surface 5*a* of the load bar 5.

Figure 4:
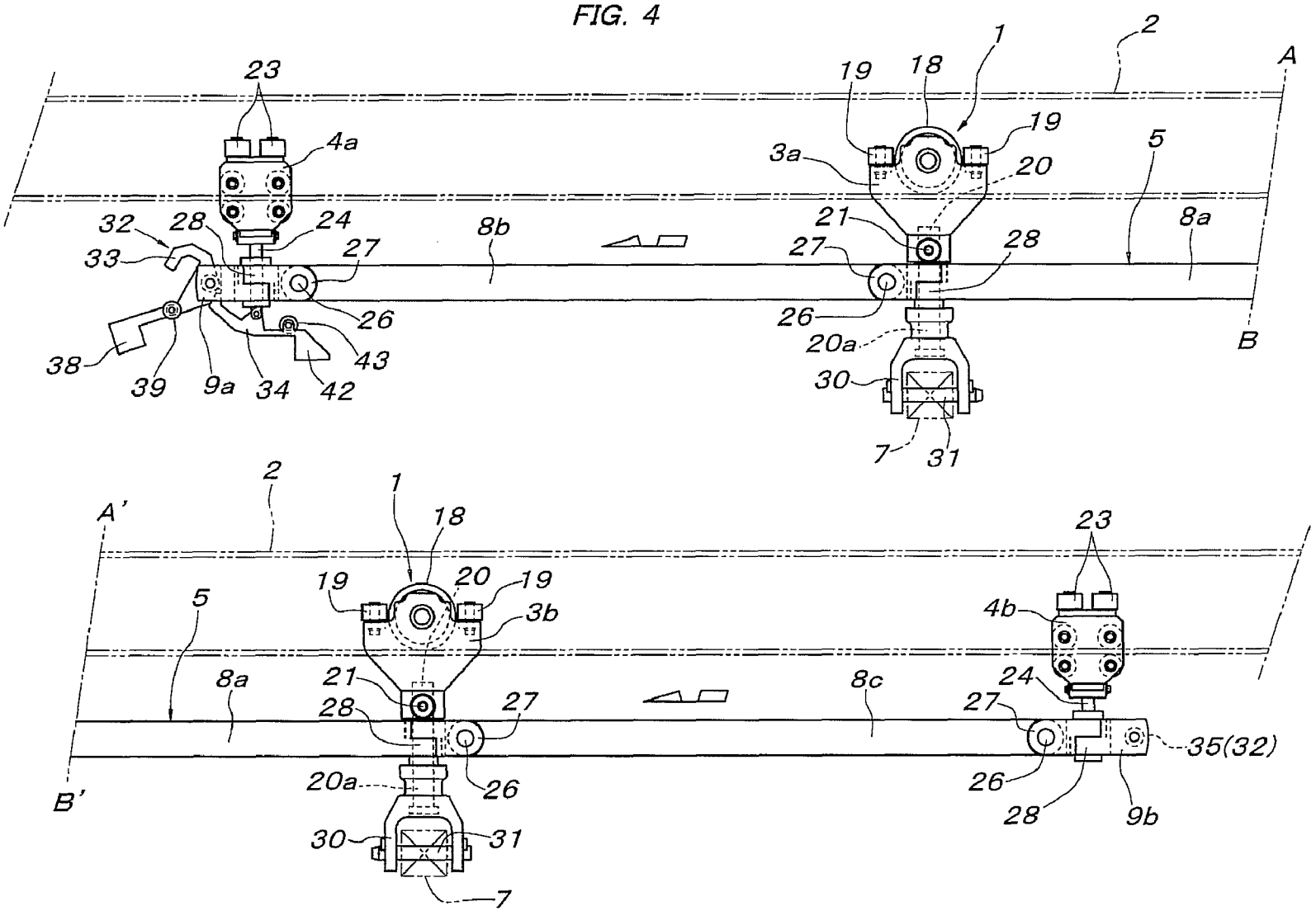
FIG. 4 is a side view showing the conveying traveling body linked by the line A-B and the line A'-B'.
Figure 5:
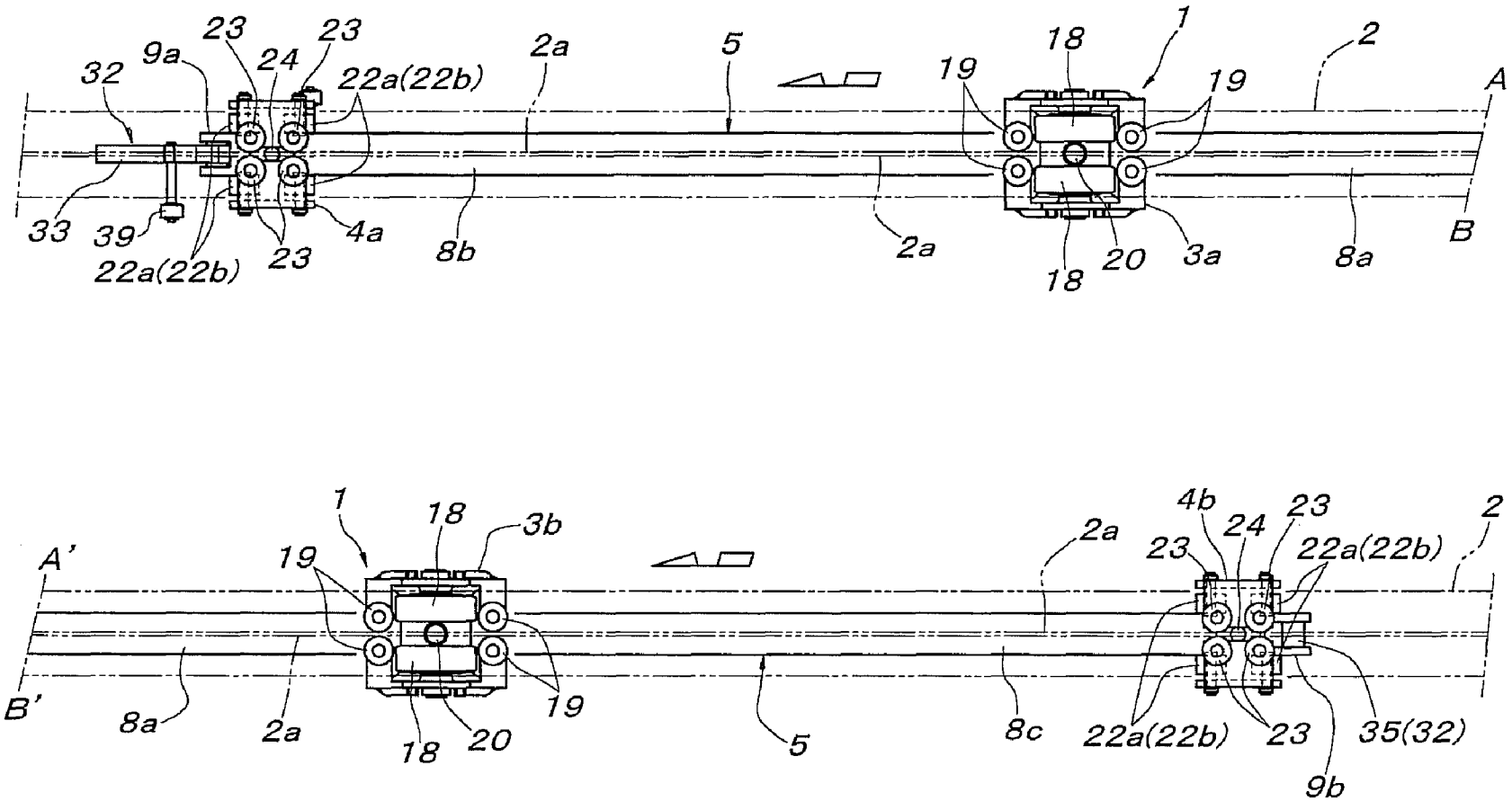
FIG. 5 is a plan view showing the conveying traveling body linked by the line A-B and the line A'-B'.
Figure 7:
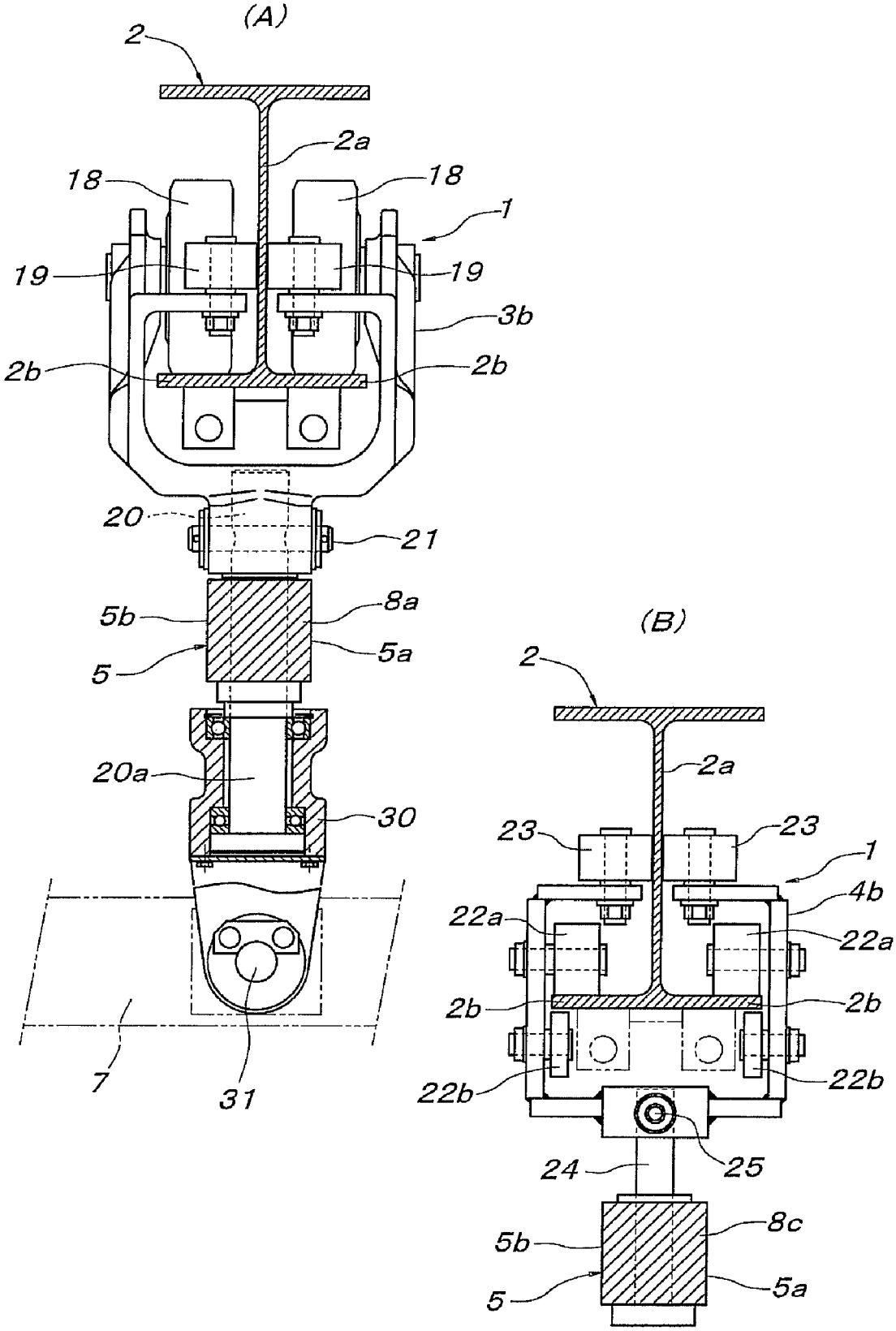
FIG. 7A is a longitudinal sectional front view at a load trolley position of the conveying traveling body on the traveling route.
FIG. 7B is a longitudinal sectional front view at a free trolley position of the conveying traveling body on the traveling route.

Hereinafter, detailed description is given. As shown in FIGS. 4, 5 and 7A, a pair of front and rear load trolleys 3*a*, 3*b* include a pair of left and right main wheels 18 rolling on a pair of left and right lower side horizontal rail portions 2*b* which protrude to the left and right sides from a lower side of a central vertical plate portion 2*a* of the guide rail 2 utilizing an H-shaped steel, and two front and rear pairs of left and right vertical axis rollers 19 sandwiching the central vertical plate portion 2*a* at the front and rear sides of the main wheel 18. A vertical axis 20 protruding vertically downward is fixed by a check pin 21 at a central position directly below the guide rail 2. As shown in FIGS. 4, 5 and 7B, the front and rear end free trolleys 4*a*, 4*b* are provided with a pair of upper and lower horizontal axis rollers 22*a*, 22*b* sandwiching the pair of left and right lower side horizontal rail portions 2*b* of the guide rail 2 at four places of front, rear, left and right, and further include two front and rear pairs of left and right vertical axis rollers 23 sandwiching the central vertical plate portion 2*a* of the guide rail 2. In the same manner as the load trolleys 3*a*, 3*b*, a vertical axis 24 protruding vertically downward is fixed by a check pin 25 at a central position directly below the guide rail 2.

Out of three intermediate load bar units 8*a* to 8*c* of the load bar 5, intermediate load bar units 8*b*, 8*c* joining the load trolleys 3*a*, 3*b* and the front and rear end free trolleys 4*a*, 4*b* are provided with vertically bent joint portions 27 vertically bendable about a horizontal support shaft 26, in positions near both ends thereof. Adjacent ends of respective intermediate load bar units 8*a* to 8*c* and the front and rear end load bar units 9*a*, 9*b* in the longitudinal direction of the load bar are joined with each other via horizontally bent joint portions 28 horizontally bendable about the vertical axes 20, 24 protruding vertically downward from respective trolleys 3*a* to 4*b*. Only the short front and rear end load bar units 9*a*, 9*b* are key-stopped by the vertical axes 24 protruding vertically downward from the front and rear end free trolleys 4*a*, 4*b*, and then integrated with the free trolleys 4*a*, 4*b*.

The vertical axis 20 protruding vertically downward from the pair of front and rear load trolleys 3*a*, 3*b*, as shown in FIG. 7A, extends downwardly long and has a lower end extending portion 20*a* on which a hanger suspending bracket 30 is supported rotatably about the vertical axis 20. On a pair of front and rear hanger suspending brackets 30, an upper frame 7 of the hanger 6 is horizontally and vertically swingably suspended via a horizontal support shaft 31 parallel to the traveling direction of the hanger.

According to the conveying traveling body 1 as configured above, each trolley 3*a* to 4*b* is suspended on the lower side horizontal rail portion 2*b* of the guide rail 2 by the main wheel 18 and upper side horizontal axis roller 22*a* while regulated by the two front and rear pairs of left and right vertical axis rollers 19, 23 so as to be in parallel with the central vertical plate portion 2*a* of the guide rail 2. Further, the pair of front and rear load trolleys 3*a*, 3*b* are prevented from being floated with respect to the lower side horizontal rail portion 2*b* of the guide rail by loads including the hanger 6 suspended thereon. The front and rear end free trolleys 4*a*, 4*b* are prevented from being floated with respect to the lower side horizontal rail portion 2*b* of the guide rail by the lower side horizontal axis roller 22*b*. As a matter of course, to the pair of front and rear load trolleys 3*a*, 3*b* as well, a horizontal axis roller abutting against the lower side of the lower side horizontal rail portion 2*b* of the guide rail and preventing the trolleys 3*a*, 3*b* from being floated may be provided.

Further, the vertically bent joint portions 27 are arranged in the above-described positions to the load bar 5 suspended on and joining respective trolleys 3*a* to 4*b*. Thus, when the traveling route of the conveying traveling body 1, that is, the guide rail 2 has any up and down slope route section, each trolley 3*a* to 4*b* is capable of traveling along the up and down slope route section of the guide rail 2 along with a vertical bending movement about the horizontal support shaft 26 at the horizontally bent joint portion 27 provided on the load bar 5. Further, since the load bar 5 is provided with horizontally bent joint portions 28 in the above-described positions, when the traveling route of the conveying traveling body 1, that is, the guide rail 2 has any horizontal curved route section, each trolley 3*a* to 4*b* is capable of traveling along the horizontal curved route section of the guide rail 2 along with a horizontal bending movement about the vertical axis 20, 24 at the horizontally bent joint portion 28 provided on the load bar 5.

On the other hand, when the conveying traveling body 1 travels along the horizontal curved route section, the front and rear end load bar units 9*a*, 9*b* of the load bar 5 are integrated with the front and rear end free trolleys 4*a*, 4*b* as described above, so that the direction is regulated to a tangential direction passing through the axis center of the vertical axis 24 of the free trolleys 4*a*, 4*b* relative to the center line of the horizontal curved route section. Moreover, these front and rear end load bar units 9*a*, 9*b* are very short in protrusion length in the forward and backward direction from the free trolleys 4*a*, 4*b*. Accordingly, distal end surfaces of the front and rear end load bar units 9*a*, 9*b* (front and rear end surfaces of the load bar 5) in full width cannot depart outwardly from the center line of the horizontal curved route section. In other words, in order to bring about this state, the front and rear end load bar units 9*a*, 9*b* are configured in protrusion length in the forward and backward direction from the free trolleys 4*a*, 4*b*, width of the distal end surfaces and radius of curvature of the horizontal curved route section.

Thus, when each conveying traveling body 1 passes through the position of the friction drive means 13, the friction drive wheel 14 of the friction drive means 13 pressure-contacts with the side surface 5*a* of the load bar 5. Therefore, if the friction drive wheel 14 is rotation-driven by the motor 16 in a predetermined direction at a predetermined speed at that moment, the conveying traveling body 1 is propelled by the friction drive wheel 14 in the predetermined direction at the predetermined speed. Accordingly, each conveying traveling body 1 can travel at the predetermined speed without any halt if the friction drive means 13 is arranged on the traveling route of the conveying traveling body 1 at intervals identical to or slightly shorter than the entire length of the load bar 5.

In the traveling route of the conveying traveling body 1, a traction drive section is arranged. In order to make a traction drive in the traction drive section possible, traction purpose engaging means 32 are provided at the front and rear ends of the load bar 5 in the present invention, as shown in FIGS. 1 to 6. The traction purpose engaging means 32 is constituted by a hook member 33 and a locking member 34 which are provided at the front end of the load bar 5 and an engaged shaft 35 provided at the rear end of the load bar 5.

Hereinafter, the traction purpose engaging means 32 is described in detail based on FIGS. 8 to 10. The front end load bar unit 9*a* of the load bar 5 is provided with a notched depression portion 36 from the distal end surface thereof and has a planar shape formed into a bifurcated shape. The hook member 33 has such a thickness so that it is loosely fitted within the notched depression portion 36 in whole, and the hook member 33 is vertically swingably pivotally supported by a horizontal support shaft 37 provided within the notched depression portion 36. The hook member 33 extends upward and forward from inside the notched depression portion 36 and has a distal end that is bent downward, and thus is of an inverted U-shape with the lower end opened. The hook member 33 includes a downward extending portion 33*b* extending diagonally forward and downward from a pivotal support position of the support shaft 37, and a lower end portion of the downward extending portion 33*b* is enlarged and constitutes a plumb bob portion 38. Additionally, at an intermediate position of the downward extending portion 33*b*, there is provided a switching purpose operated portion (cam follower roller rotatable about a horizontal support shaft) 39 protruding to one of the left and right sides at the lower side of the load bar 5.

The locking member 34 is pivotally supported vertically swingably by a horizontal support shaft 40, posterior to the hook member 33 at the lower side of the front end load bar unit 9*a*, more specifically, at the lower end of the fixed vertical axis 24 hanging from the front end free trolley 4*a* to which the front end load bar unit 9*a* is fixed. The locking member 34 includes a distal nail portion 41 continuously provided while bent upwardly from a distal end of a portion 34*a* extending forward from the pivotal support position of the support shaft 40, a plumb bob portion 42 formed by enlarging a rear end portion of a portion 34*b* extending rearward from the pivotal support position, and a switching purpose operated portion (cam follower roller rotatable about a horizontal support shaft) 43 protruding from an intermediate position of the rear extending portion 34*b* to the other side of the left and right sides at the lower side of the load bar 5, that is, the opposite side of the side to which the switching purpose operated portion 39 of the hook member 33 side protrudes.

The rear end load bar unit 9*b* of the load bar 5 is provided with a notched depression portion 44 from a distal end surface thereof and has a planar shape formed into a bifurcated shape. Inside the notched depression portion 44, the engaged shaft 35 is arranged. The engaged shaft 35 and the support shaft 37 pivotally supporting the hook member 33 are on the same level, and as obvious from the above configuration, both are located at an intermediate position in vertical height of the load bar 5 (the front and rear end load bar units 9*a*, 9*b*). Further, the notched depression portion 36 at the front end of the load bar 5 and the notched depression portion 44 at the rear end of the load bar 5 have the same width. The notched depression portion 44 at the rear end of the load bar 5 has such a depth that a distal upright portion 33*a* of the hook member 33 can be engaged with the engaged shaft 35.

According to the above configuration, the hook member 33 is urged to such a direction that the distal upright portion 33*a* rotates downwardly by gravity (downward biasing force) acted upon the plumb bob portion 38. By this urging force, the hook member 33 is held in an engaged posture that a rear side surface of the hook member 33 abuts against a rear side surface 36*a* of the notched depression portion 36 and the distal upright portion 33*a* is vertically oriented in a position just before the load bar 5, as shown in FIG. 8A. On the other hand, the locking member 34 is urged as well to such a direction that the distal nail portion 41 rotates upward by gravity (downward urging force) acted upon the plumb bob portion 42. Since the distal nail portion 41 abuts against a rear side surface of the downward extending portion 33*b* of the hook member 33, the locking member 34 is held in a non-operated state with respect to the hook member 33. When the hook member 33 is switched from that state to a disengaged posture as the distal upright portion 33*a* rotates upwardly as shown in FIG. 8B, a space into which the distal nail portion 41 of the locking member 34 is fitted upwardly is formed between the rear side surface of the hook member 33 and the rear side surface 36*a* of the notched depression portion 36. Thus, the locking member 34 with the distal nail portion 41 urged to the upward moving direction rotates about the support shaft 40, and the distal nail portion 41 is automatically fitted between the rear side surface of the hook member 33 and the rear side surface 36*a* of the notched depression portion 36 as illustrated, thereby holding the hook member 33 in the disengaged posture. Further, when the locking member 34 rotates about the support shaft 40 from this state to such a direction that the distal nail portion 41 moves downwardly, the distal nail portion 41 gets out downward from between the rear side surface of the hook member 33 and the rear side surface 36*a* of the notched depression portion 36, and then the hook member 33 rotates about the support shaft 37 to such a direction that the distal upright portion 33*a* moves downwardly by the urging force to be switched from the disengaged posture to the engaged posture and then held in the engaged posture.

Within the traction drive section provided in the traveling route of the conveying traveling body 1, the friction drive means 13 is provided at every two or more times of the full length of the load bar 5 or only at an exit if the traction drive section is relatively short. Therefore, within the traction drive section, as shown in FIG. 8A or FIG. 10, the distal upright portion 33*a* of the hook member 33 in the engaged posture located at the front end of the load bar 5 of the rear side conveying traveling body 1 is engaged with the engaged shaft 35 provided at the rear end of the load bar 5 of the front side conveying traveling body 1. The conveying traveling bodies 1 adjacent back and forth are joined with each other via the load bar 5 and traction purpose engaging means 32. Accordingly, by propelling a conveying traveling body 1 by the friction drive means 13 provided at the exit or intermediate position of the traction drive section, other conveying traveling bodies 1 which follow the conveying traveling body 1 propelled by the friction drive means 13 and are joined via the traction purpose engaging means 32 are all pulled in a line and travel as well.

On the other hand, when conveying traveling bodies 1 joined with each other via the traction purpose engaging means 32 as described above are traction-driven, a slight clearance is produced between the load bars 5 of the conveying traveling bodies 1 adjacent back and forth, that is, between the distal end surfaces of the front and rear end load bar units 9*a*, 9*b*, as shown in FIG. 8A. However, the friction drive wheel 14 of the friction drive means 13 shifts smoothly from the rear end of the side surface 5*a* of the load bar 5 of the front side conveying traveling body 1 to the front end of the side surface 5*a* of the load bar 5 of the rear side conveying traveling body 1, and then propels and drives the rear side conveying traveling body 1 as well in the same manner. Thus, all conveying traveling bodies 1 joined with each other within the traction drive section come to be sent out from the traction drive section without fail. As a matter of course, the support shaft 37 and engaged shaft 35 of the traction purpose engaging means 32 are provided such that their both ends do not protrude from the side surfaces 5*a*, 5*b* of the load bar 5, and are configured so as not to affect the friction drive by the friction drive means 13.

When each conveying traveling body 1 sent out from the traction drive section is separated from its following conveying traveling body 1 and made to travel at a high speed, a friction drive means 13 for high speed drive is provided outside the traction drive section. However, there is a need to release the joint by the traction purpose engaging means 32 and separate the load bar 5 of the conveying traveling body 1 from the load bar 5 of the following conveying traveling body 1 before the load bar 5 of the conveying traveling body 1 is driven by the friction drive means 13 for high speed drive. Therefore, as shown in FIG. 8A and FIG. 9, a first switching means 45 switching the hook member 33 from the engaged posture to the disengaged posture is provided in a section for releasing the joint by the traction purpose engaging means 32.

The first switching means 45 is composed of a cam rail 46 acting upon the switching purpose operated portion 39 of the hook member 33. As shown in FIG. 8A and 9, the cam rail 46 includes an ascending slope portion 46*a* pushing forward and upward the switching purpose operated portion 39 of the hook member 33 at the front end of the load bar 5 along with the travel of the conveying traveling body 1, and a horizontal portion 46*b* following the ascending slope portion 46*a*. Thus, the switching purpose operated portion 39 of the hook member 33 in the engaged posture runs onto the ascending slope portion 46*a* of the cam rail 46 along with the travel of the conveying traveling body 1, whereupon the hook member 33 rotates about the support shaft 37 in the disengaged direction, the distal upright portion 33*a* is separated upwardly from the engaged shaft 35 provided at the rear end of the load bar 5 of the immediately preceding conveying traveling body 1, and the hook member 33 is switched into the disengaged posture. As long as the switching purpose operated portion 39 of the hook member 33 is moving on the horizontal portion 46*b* of the cam rail 46, the hook member 33 is held in the disengaged posture. Thus, during that time, the immediately preceding conveying traveling body 1 can be driven at high speed by the friction drive means 13 for high speed drive and separated forwardly from the following conveying traveling body 1 whose hook member 33 is held in the disengaged posture.

Figure 9:
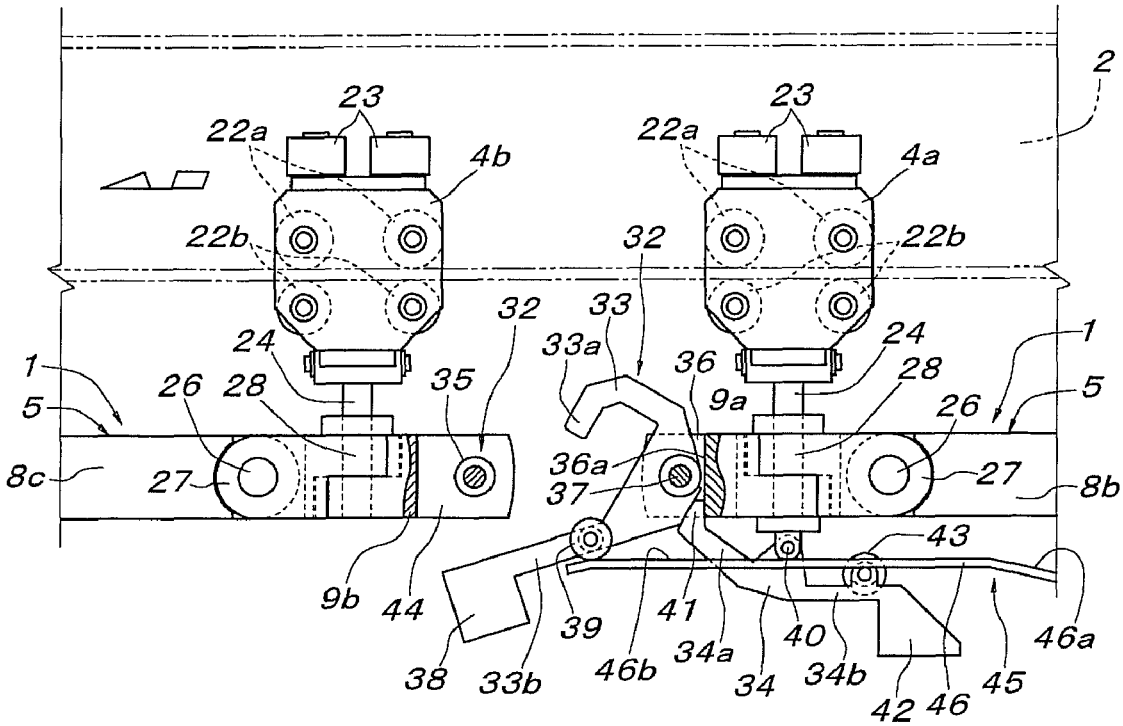
FIG. 9 is a partial longitudinal sectional side view showing a state just after the joint by the traction purpose engaging means is released and a front side conveying traveling body is separated and made to travel forward.

On the other hand, when the hook member 33 is switched into the disengaged posture on the cam rail 46, the locking member 34 held in the non-operated posture by the distal nail portion 41 abutting against the rear side surface of the hook member 33 is automatically switched into the operated posture by the urging force as described above, and the distal nail portion 41 holds the hook member 33 in the disengaged posture as shown in FIG. 9. Accordingly, the hook member 33 does not return to the engaged posture again even if the switching purpose operated portion 39 of the hook member 33 goes off the horizontal portion 46*b* of the cam rail 46.

In order that the conveying traveling bodies 1 sent out from the section for releasing the joint by the traction purpose engaging means 32 as above and driven by the friction drive means 13 individually one by one, that is, the conveying traveling bodies 1 whose hook member 33 is held in the disengaged posture by the locking member 34, are brought into a state of being able to be joined by the traction purpose engaging means 32 and traction-driven as above, a joint section in which a conveying traveling body 1 with the hook member 33 held in the disengaged posture can thrust and drive its immediately preceding conveying traveling body 1 is provided as shown in FIG. 8B. The friction drive means 13 is arranged at an entrance of the joint section. The conveying traveling body 1 sent into the joint section by the friction drive means 13 stops at a position where its load bar 5 goes off the friction drive wheel 14 of the friction drive means 13. In this state, the following conveying traveling body 1 is sent into the joint section by the friction drive means 13 in the same manner, and accordingly the following conveying traveling body 1 sent by the friction drive means 13 thrusts the rear end of the load bar 5 of the immediately preceding stopping conveying traveling body 1 by the front end of the load bar 5 thereof, whereupon the two front and rear conveying traveling bodies 1 come to travel in a line within the joint section. At this moment, in order to prevent the thrust front side conveying traveling body 1 from advancing away from the rear side conveying traveling body 1 due to inertia at the time of collision by the load bar 5 of the rear side conveying traveling body 1, there can be juxtaposed a braking means which acts upon the load bar 5 of the conveying traveling body 1 being off the friction drive wheel 14 of the friction drive means 13 and stopping and provides the conveying traveling body 1 with braking force.

A second switching means 47 is provided in the aforementioned joint section. The second switching means 47 switches the hook member 33 in the disengaged posture provided at the front end of the load bar 5 of the rear side conveying traveling body 1 into the engaged posture as shown in FIG. 8B and FIG. 10 while the front side conveying traveling body 1 sent into the joint section and stopped is thrust and driven by the rear side conveying traveling body 1 sent into the joint section by the friction drive means 13. More directly, the second switching means 47 is composed of a cam rail 48 acting upon the switching purpose operated portion 43 of the locking member 34 in order to switch the locking member 34 in the operated posture which holds the hook member 33 in the disengaged posture into the non-operated posture.

The cam rail 48 of the second switching means 47 includes an ascending slope portion 48*a* pushing rearward and upwardly the switching purpose operated portion 43 of the locking member 34 at the front end of the load bar 5 along with the travel of the conveying traveling body 1, and a horizontal portion 48*b* following the ascending slope portion 48*a*. Thus, the switching purpose operated portion 43 of the locking member 34 in the operated posture runs onto the ascending slope portion 48*a* of the cam rail 48 along with the travel of the conveying traveling body 1, whereupon the locking member 34 rotates about the support shaft 40 in such a direction that the distal nail portion 41 moves downwardly, and the distal nail portion 41 gets out downwardly from between the rear side surface of the hook member 33 in the disengaged posture and the rear side surface 36*a* of the notched depression portion 36. As a result, the hook member 33 in the disengaged posture rotates about the support shaft 37 in such a direction that the distal upright portion 33*a* moves downwardly, by the urging force. Accordingly, the distal upright portion 33*a* of the hook member 33 comes to automatically be engaged with the engaged shaft 35 provided at the rear end of the load bar 5 of the immediately preceding thrust-driven conveying traveling body 1.

More specifically, when the conveying traveling body 1 sent into the joint section as described above thrusts and drives the immediately preceding stopping conveying traveling body 1, it is configured such that while the front end of the load bar 5 of the rear side conveying traveling body 1 abuts against the rear end of the immediately preceding stopping conveying traveling body 1, the rear side conveying traveling body 1 can thrust and drive the front side conveying traveling body 1 by the load bars 5 of the front and rear side conveying traveling bodies 1, as shown in FIG. 8B. In other words, it is configured such that when the rear side conveying traveling body 1 with the hook member 33 held in the disengaged posture at the front end of the load bar 5 approaches the stopping front side conveying traveling body 1, the engaged shaft 35 provided at the rear end of the load bar 5 of the stopping front side conveying traveling body 1 and the hook member 33 in the disengaged posture provided at the front end of the load bar 5 of the rear side conveying traveling body 1 collide with each other and the thrust-drive cannot be performed via the hook member 33 in the disengaged posture and engaged shaft 35 abutting against thereto.

Figure 10:
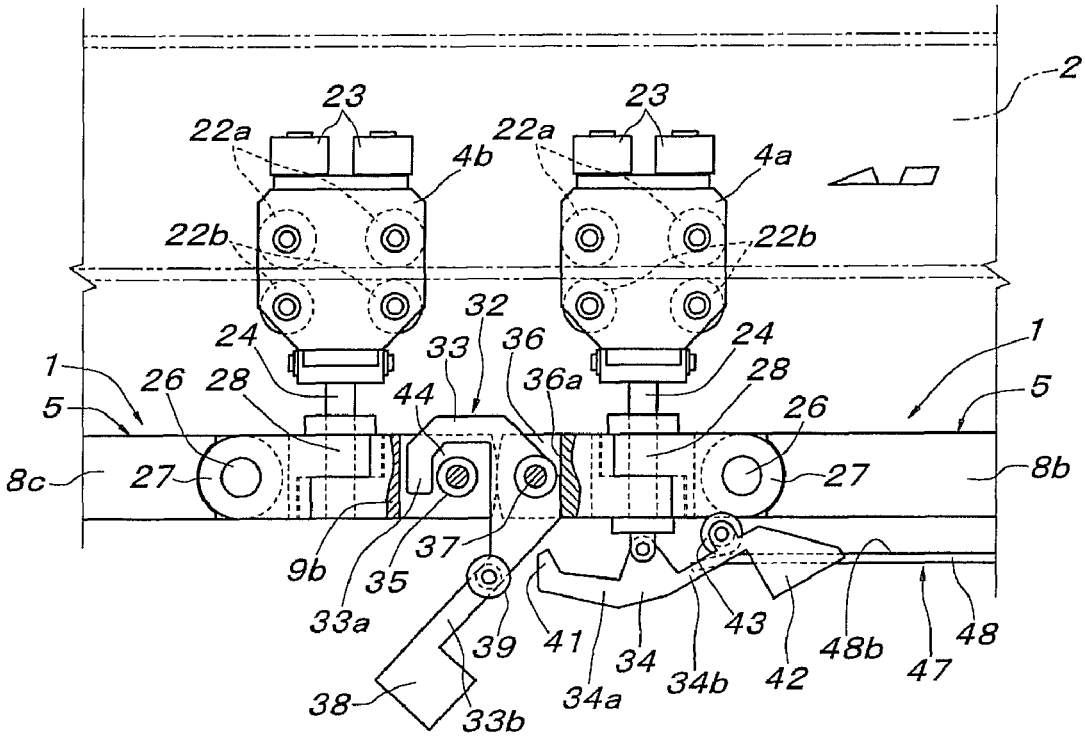
FIG. 10 is a partial longitudinal sectional side view showing a thrust drive state just after the traction purpose engaging means is switched to a joined state.

As shown in FIG. 10, after the hook member 33 provided at the front end of the load bar 5 of the rear side conveying traveling body 1 is switched into the engaged posture via the cam rail 48 of the second switching means 47 and the locking member 34 with the load bars 5 thrusting with each other as above, the switching purpose operated portion 43 of the locking member 34 departs from the horizontal portion 48*b* of the cam rail 48 and the locking member 34 goes to return to the operated posture due to the urging force. However, as shown in FIG. 8A, the distal nail portion 41 of the locking member 34 mounts by abutting against the rear side surface of the hook member 33 having been switched into the engaged posture, and the hook member 33 having been switched into the engaged posture is held in the engaged posture by the urging force. As a result, the hook member 33 does not return to the original disengaged posture.

By repeating the above operation, the conveying traveling bodies 1 sent into the joint section provided with the friction drive means 13 and second switching means 47 at the entrance side thereof are sent out from the joint section after the conveying traveling bodies 1 adjacent back and forth are automatically joined with each other by the traction purpose engaging means 32 while thrust-driven by the rear side conveying traveling body 1 via respective load bars 5. Thus, the conveying traveling bodies 1 joined with each other and sent out from the joint section are sent into the above-described traction drive section, thereby allowing each conveying traveling body 1 to be traction-driven in turn by the traction purpose engaging means 32 and load bar 5 as described above.

Figure 8:
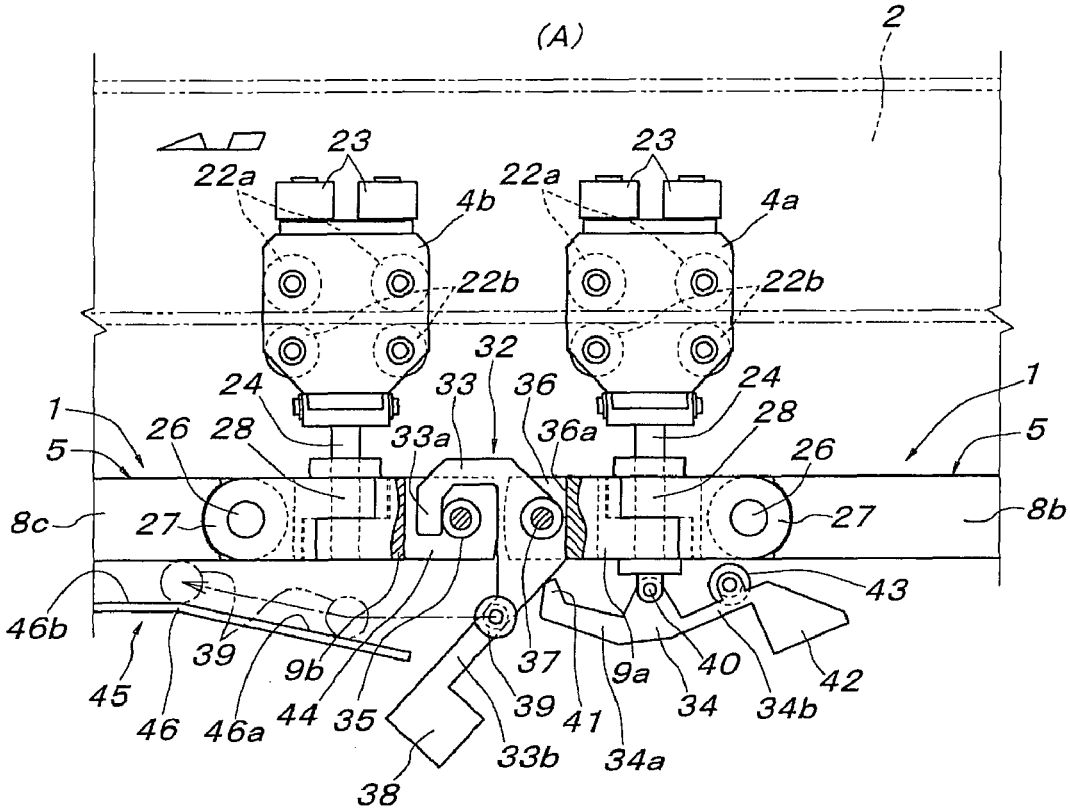
FIG. 8A is a partial longitudinal sectional side view showing a traction drive state by a traction purpose engaging means.
FIG. 8B is a partial longitudinal sectional side view showing a thrust drive state just before the traction purpose engaging means is switched to a joined state.
Figure 8:
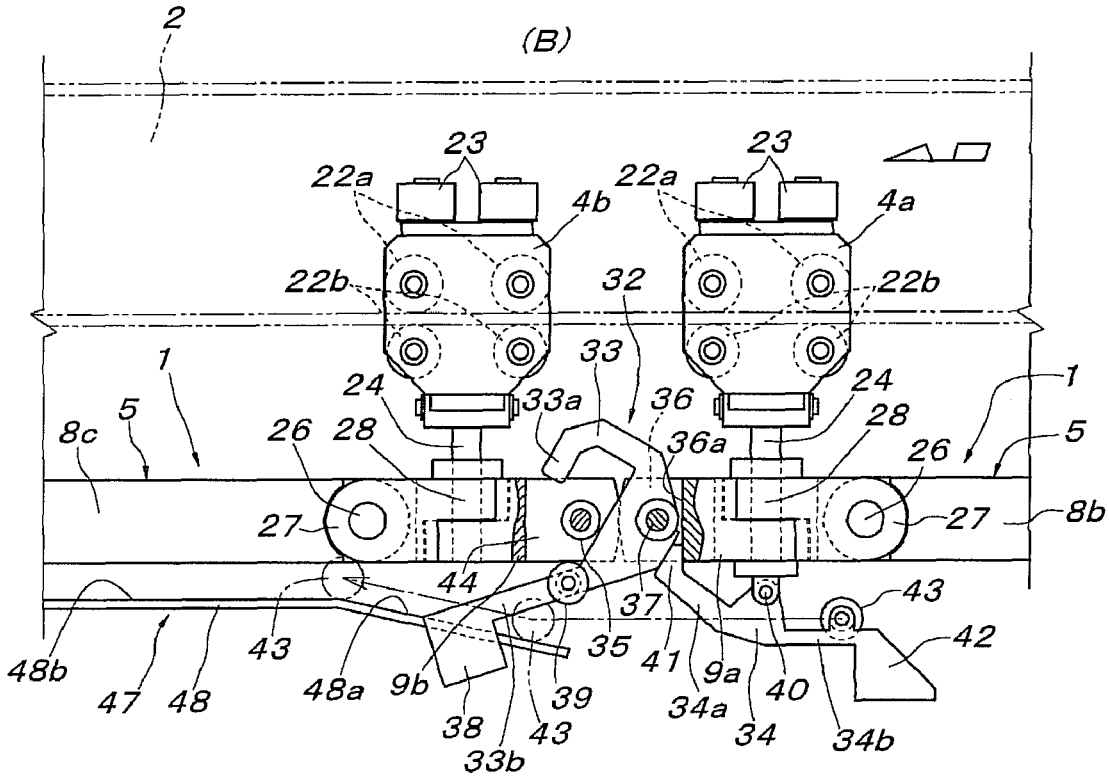
Figure 11:
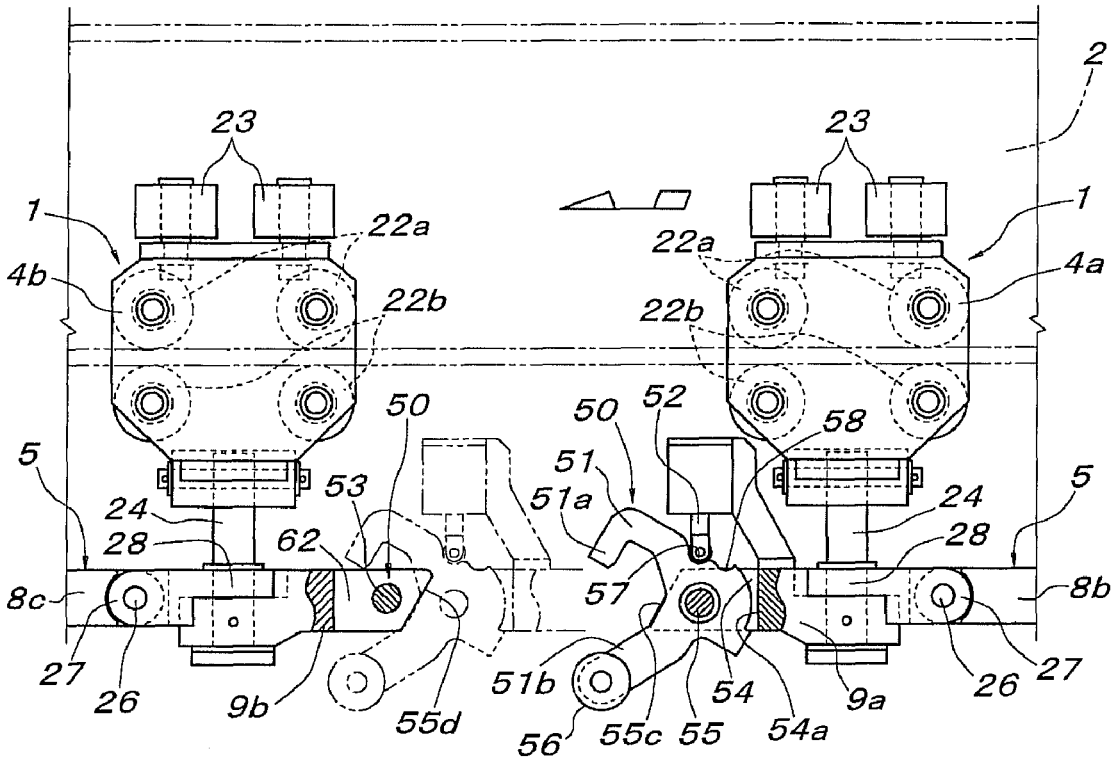
FIG. 11 is a partial longitudinal sectional side view showing a disjoined state of a traction purpose engaging means according to another embodiment.
Figure 12:
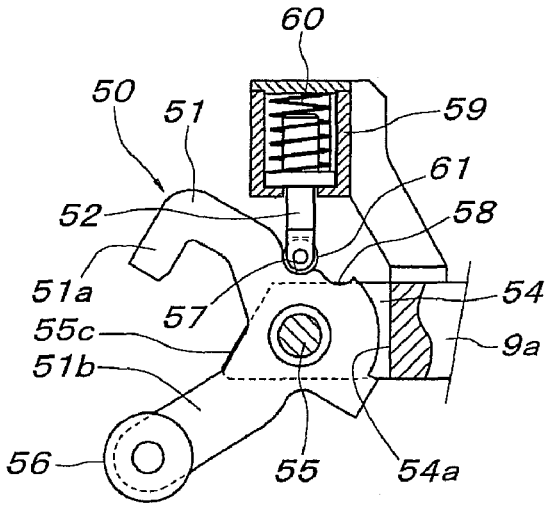
FIG. 12 is a partial longitudinal sectional side view showing a structure of a hook member side of the traction purpose engaging means.
Figure 13:
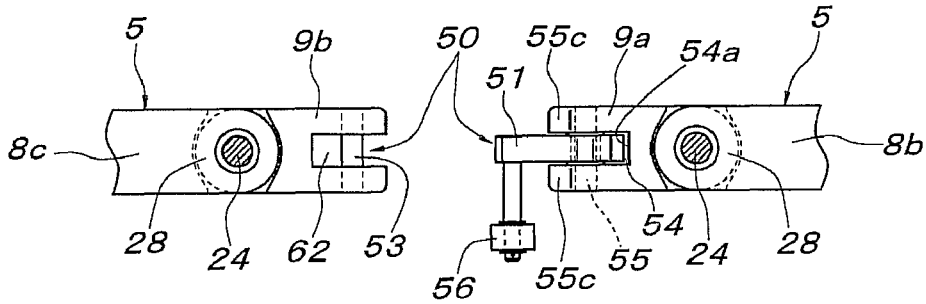
FIG. 13 is a partial cross sectional plan view showing a disjoined state of the traction purpose engaging means.

A traction purpose engaging means is not restricted to the traction purpose engaging means 32 as shown in FIGS. 8 to 10. For example, it may be a traction purpose engaging means 50 as shown in FIGS. 11 to 13. This traction purpose engaging means 50 is composed of a hook member 51 pivotally supported at the front end of the load bar 5, that is, at the front end load bar unit 9*a*, a spring-urged lock member 52 holding the hook member 51 in the engaged posture or the disengaged posture in an alternative way and an engaged shaft 53 provided at the rear end of the load bar 5, that is, at the rear end load bar unit 9*b*. The locking member 34 in the aforementioned embodiment is omitted.

Hereinafter, the traction purpose engaging means 50 is described in detail. The front end load bar unit 9*a* of the load bar 5 is provided with a notched depression portion 54 from a distal end surface thereof and has a planar shape formed into a bifurcated shape. The hook member 51 having such a thickness so that it is loosely fitted within the notched depression portion 54 in whole is vertically swingably pivotally supported by a horizontal support shaft 55 provided within the notched depression portion 54. The hook member 51 is of such an inverted U-shape with a lower side opened that extends upwardly and forward from within the notched depression portion 54 and has a distal end which bends downwardly. The hook member 51 includes a downward extending portion 51*b* extending diagonally forward and downwardly from a pivotal support position of the support shaft 55. At a lower end part of the downward extending portion 51*b*, there is provided a switching purpose operated portion (cam follower roller rotatable about a horizontal support shaft) 56 protruding to one of the left and right sides at the lower side of the load bar 5.

Two engaged depression portions 57, 58 are circumferentially provided on an upper side circumferential surface of the support shaft 55 of the hook member 51. The spring-urged lock member 52 is arranged immediately above the support shaft 55 of the hook member 55. While concentric to a vertical shaft center passing through the shaft center of the support shaft 55 of the hook member 51, the lock member 52 is elevatably supported by a case 59 supported on the upper side of the front end load bar unit 9*a* and also is urged downwardly by a compression coil spring 60 provided within the case 59. A horizontal axis roller 61 fitting to the two engaged depression portions 57, 58 of the hook member 51 in an alternative way is pivotally supported at the lower end.

The rear end load bar unit 9*b* of the load bar 5 is provided with a notched depression portion 62 from a distal end surface thereof and has a planar shape formed into a bifurcated shape. The engaged shaft 53 is arranged within the notched depression portion 62. The engaged shaft 53 and the support shaft 55 pivotally supporting the hook member 51 are on the same level, and as obvious from the above configuration, both are located on an intermediate position in vertical height of the load bar 5 (front and rear end load bar units 9*a*, 9*b*). Further, the notched depression portion 54 at the front end of the load bar 5 and the notched depression portion 62 at the rear end of the load bar 5 have the same width. The notched depression portion 62 at the rear end of the load bar 5 has such a depth that the distal upright portion 51*a* of the hook member 51 can be engaged with the engaged shaft 53.

Figure 14:
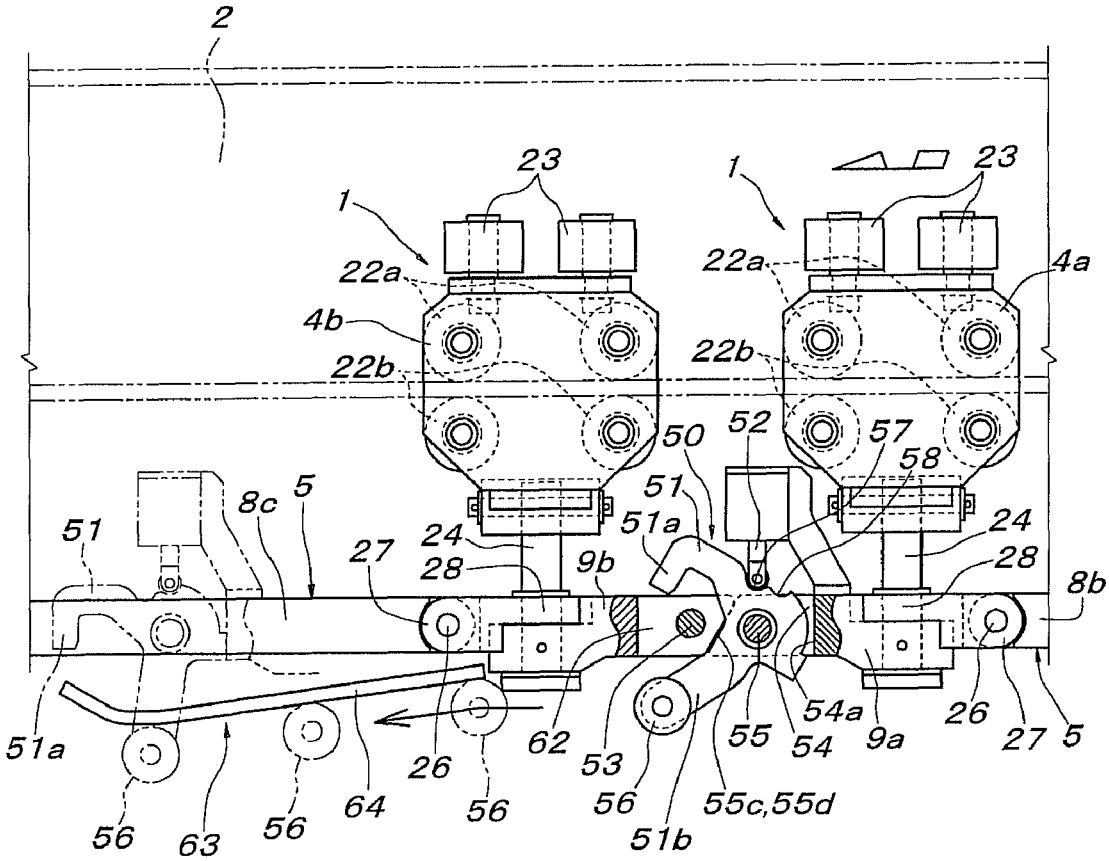
FIG. 14 is a partial longitudinal sectional side view showing a thrust drive state just before the traction purpose engaging means is switched into a joined state.
Figure 15:
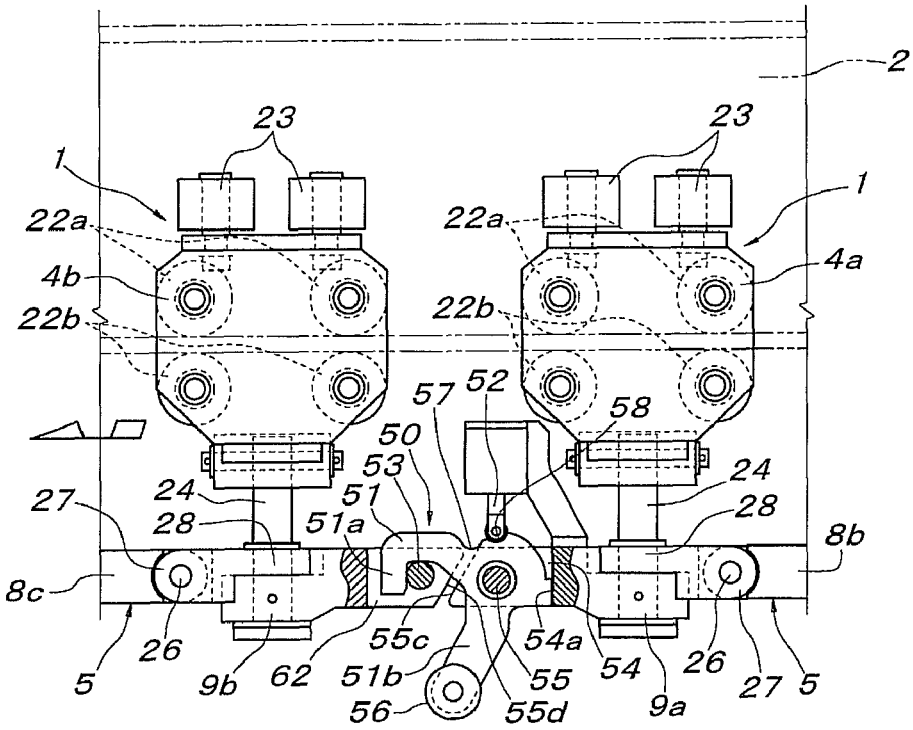
FIG. 15 is a partial longitudinal sectional side view showing a traction drive state of the traction purpose engaging means.
Figure 16:
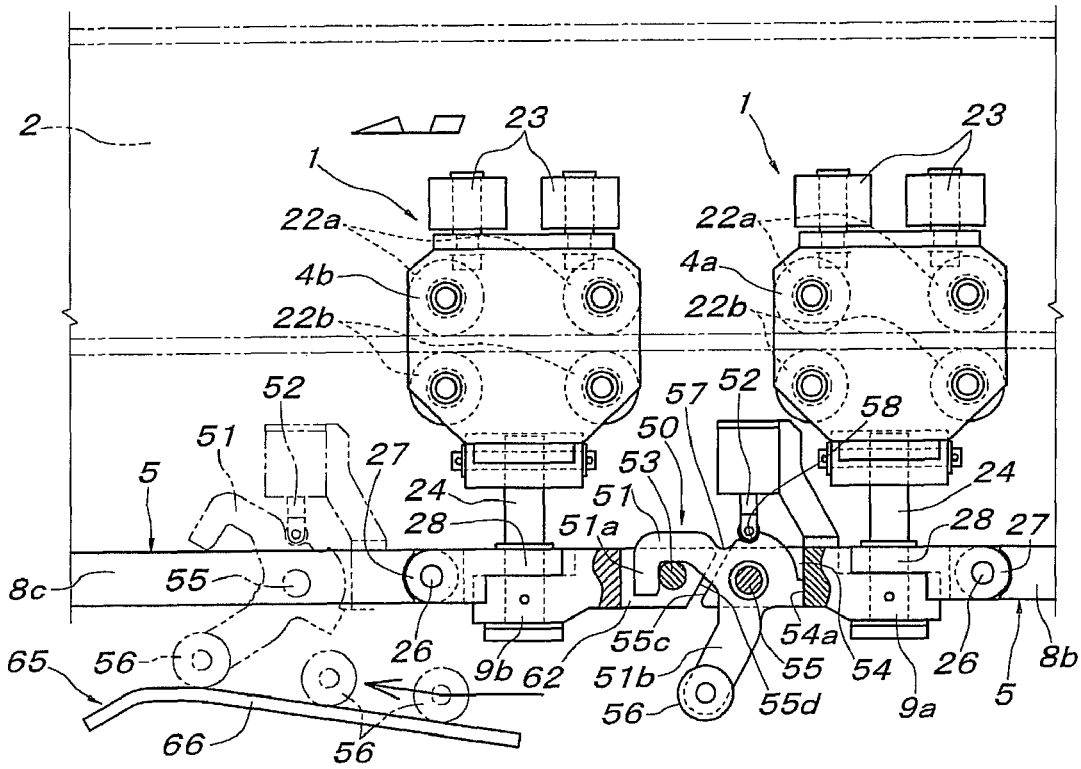
FIG. 16 is a partial longitudinal sectional side view showing a traction drive state just before the joint by the traction purpose engaging means is released.

As shown in FIGS. 11, 12 and 14, the hook member 51 abuts against the lower end part of the lock member 52 and a further rotation is restrained when the hook member 51 is made to rotate about the support shaft 55 in an upwardly moving direction of the distal upright portion 51*a*. In this disengaged posture, the lower end horizontal axis roller 61 of the lock member 52 is fitted into the engaged depression portion 57 and held by the urging force of the compression coil spring 60. When the hook member 51 is made to counter-rotate about the support shaft 55 in a downward moving direction of the distal upright portion 51*a* from that state, as shown in FIG. 15 and FIG. 16, the hook member 51 takes an engaged posture where the rear side surface of the hook member 51 abuts against the rear side surface 54*a* of the notched depression portion 54 and also the distal upright portion 51*a* is vertically oriented in a position immediately before the load bar 5. In this engaged posture, the lower end horizontal axis roller 61 of the lock member 52 is fitted into the engaged depression portion 58 and held by the urging force of the compression coil spring 60.

As a preliminary step for joining load bars 5 of respective conveying traveling bodies 1 together by the traction purpose engaging means 50 when the above configured traction purpose engaging means 50 is provided, as shown in FIG. 11 and FIG. 14, the conveying traveling body 1 with the hook member 51 held in the disengaged posture is made to travel by friction-drive, and the front end surface 55*c* of the load bar 5 of the conveying traveling body 1 is made to abut against the rear end surface 55*d* of the load bar 5 of the immediately preceding conveying traveling body 1, whereupon the stopping preceding conveying traveling body 1 can be thrust-driven. The hook member 51 of the rear side conveying traveling body 1 out of the two front and rear conveying traveling bodies 1 traveling in a line in such a state that can be forcedly rotation-driven about the support shaft 55 toward the engaged posture, against disengaged posture holding force by the fitting of the lower end horizontal axis roller 61 of the lock member 52 relative to the engaged depression portion 57, by pushing down the switching purpose operated portion 56 of the hook member 51 by the cam rail 64 of the second switching means 63 and the travel of the conveying traveling body 1 as shown in FIG. 14. As a result, the hook member 51 is switched into the engaged posture as shown by the virtual line in FIG. 14 and also held in that engaged posture by the fitting of the lower horizontal axis roller 61 of the lock member 52 relative to the engaged depression portion 58. Accordingly, the distal upright portion 51*a* of the hook member 51 is engaged with the engaged shaft 53 provided at the rear end of the load bar 5 of the immediately proceeding thrust-driven conveying traveling body 1, whereupon the two front and rear conveying traveling bodies 1 are joined with each other via the load bars 5 and traction purpose engaging means 50.

If a predetermined number of conveying traveling bodies 1 are joined with each other in the above manner, the friction-drive of the leading side conveying traveling body 1 will allow the following conveying traveling body 1 to be traction-driven via the traction purpose engaging means 50 as shown in FIG. 15, as described in the foregoing embodiment.

In order that the joint by the traction purpose engaging means 50 is released and the leading conveying traveling body 1 is separated forwardly by high speed drive, as shown in FIG. 16, the hook member 51 is forcedly rotation-driven about the support shaft 55 toward the disengaged posture, against engaged posture holding force by the fitting of the lower end horizontal axis roller 61 of the lock member 52 relative to the engaged depression portion 58, by pushing up the switching purpose operated portion 56 of the hook member 51 of the traction purpose engaged means 50 whose joint is to be released by the cam rail 66 of the first switching means 65 and the travel of the conveying traveling body 1 as shown in FIG. 16. As a result, the hook member 51 is switched into the disengaged posture as shown by the virtual line in FIG. 16 and held in that disengaged posture by the fitting of the lower end horizontal axis roller 61 of the lock member 52 relative to the engaged depression portion 57. Accordingly, the front side conveying traveling body 1 positioned immediately before the hook member 51 having been switched into the disengaged posture is friction-driven and made to travel at a high speed, thereby being able to be separated forwardly.

In the above two embodiments, the hook member 33, 51 is provided at the front end of the load bar 5 and the engaged shaft 35, 53 is provided at the rear end of the load bar 5. However, it can be conversely configured such that the engaged shaft 35, 53 is provided at the front end of the load bar 5 and the hook member 33, 51 is provided at the rear end of the load bar 5. Further, each of the aforementioned embodiments is configured such that four trolleys 3*a* to 4*b* are used and the hanger 6 serving as the object support tool is suspended by the pair of front and rear load trolleys 3*a*, 3*b* on the middle. However, the conveying traveling body can be composed of three trolleys by joining the free trolley via the load bar only with either one of the pair of front and rear load trolleys 3*a*, 3*b* suspending the conveying traveling body 6. Furthermore, if a length of the object in the conveying direction is short, the conveying traveling body can be composed of at least two trolleys by suspending the object support tool (hanger) 6 on one load trolley and providing at least one free trolley to be joined with the one load trolley via the load bar. In either case, a length of the load bar between the free trolley and the load trolley only has to be set such that objects supported by the hangers 6 do not collide with each other at the time of thrust-driving the conveying traveling bodies 1. As a matter of course, when the conveying traveling body 1 is composed of the three or two trolleys as well, short front and rear end load bar units 9*a*, 9*b* protruding slightly forward and rearward from the trolleys placed at the front and rear ends are preferably provided at both ends of the load bar in the same manner as the embodiments.

On the other hand, when conveying traveling bodies 1 adjacent back and forth are in the state of being joined by the traction purpose engaging means 32, 50 and the front side conveying traveling body 1 is propelled by pressure contact of the friction drive wheel 14 of the friction drive means 13 relative to the side surface of the load bar 5 while the rear side conveying traveling body 1 is pulled by the traction purpose engaging means 32, 50, a clearance in the longitudinal direction of the load bar is produced between the rear end of the load bar 5 of the front side conveying traveling body 1 and the front end of the load bar 5 of the rear side conveying traveling body 1 as shown in FIG. 8 and FIG. 15. When the clearance penetrates in the vertical direction in plan view, as shown in FIG. 8, it is conceivable that the presence of the clearance may constitute an obstacle to smooth shift of the friction drive wheel 14 from the front side load bar 5 to the rear side load bar 5, and especially when a width of the clearance is wide, a possibility that the friction drive wheel 14 does not shift onto the rear side load bar 5 and the friction-drive is interrupted is also conceivable. Therefore, as adopted in the embodiment shown in FIGS. 11 to 16, the front and rear end surfaces 55*c*, 55*d* of the load bar 5 are formed into an inclined plane slanting in the same direction, so that a clearance produced between the front and rear load bars 5 in the traction drive state becomes the oblique direction when viewed from a side as shown in FIG. 15 and does not penetrate in the vertical direction in plan view. This configuration would allow the friction drive wheel 14 to constantly shift smoothly from the front side load bar 5 to the rear side load bar 5 in the friction-drive state and thus allow the friction-drive by the traction purpose engaging means 32, 50 to be well conducted without fail.

As for a method in order for the clearance produced between the front and rear load bars 5 in the friction-drive state not to penetrate in the vertical direction in plane view as described above, the front and rear end portions of the load bar 5 can be formed into steps with the top and bottom inverted so as to stack one end portion upon the other end portion of the front and rear load bars 5 in the friction-drive state. In this method, however, the front and rear end portions of the load bar 5 (front and rear end load bar units 9*a*, 9*b*) must extend further forward and rearward than the support shaft 37, 55 and engaged shaft 35, 53 of the hook member 33, 51 of the traction purpose engaging means 32, 50. In some cases, it is conceivable that the thrust-drive at the horizontal curved route could be affected. Therefore, it is preferable to obliquely incline the front and rear end surfaces 55*c*, 55*d* of the load bar 5 as described above and to achieve the intended object.

What is claimed is:

1. A friction drive trolley conveyor configured to include conveying traveling bodies and object supports suspended on the conveying traveling bodies, each conveying traveling body composed of a load trolley which supports an object, a free trolley which is located at least at either one of the front or rear of the load trolley and a load bar with both ends suspended by the trolleys and joins the trolleys together, the both ends of the load bar provided with traction purpose engaging means are engagably and disengagably engaged with each other in a state where front and rear end portions of load bars of conveying traveling bodies are close to each other; and a traveling route provided with a friction drive means including a friction drive wheel which pressure-contacts with a side surface of the load bar and is rotation-driven, whereby a conveying traveling body propelled by the friction drive means can traction-drive a following conveying traveling body joined via the traction purpose engaging means of each conveying traveling body, wherein the traction purpose engaging means comprises a vertical notched portion formed on one end of the load bar, an engaged shaft arranged in a horizontal direction to the notched portion so as to locate at an intermediate position in vertical height of the load bar, a hook member vertically swingably pivotally supported at the other end of the load bar at the intermediate position in vertical height of the load bar and being engagable and disengagable relative to the engaged shaft of the load bar of an adjacent conveying traveling body, and a holding means holding the hook member in an engaged posture or a disengaged posture in an alternative way; and the traveling route is provided with a first switching means switching the hook member from the engaged posture to the disengaged posture, and a second switching means switching the hook member from the disengaged posture to the engaged posture.

2. The friction drive trolley conveyor according to claim 1, wherein the hook member is urgedly held in the engaged posture; the holding means of the traction purpose engaging means comprises a locking member which holds the hook member having been switched from the engaged posture to the disengaged posture by the first switching means at the disengaged posture, the locking member being urgedly held in an operated posture of holding the hook member in the disengaged posture; and the second switching means switches the locking member from the operated posture to a non-operated posture.

3. The friction drive trolley conveyor according to claim 2, wherein the hook member is urgedly held in the engaged posture by a plumb bob portion extending from a pivotal support position thereof and is provided with a switching purpose operated portion protruding to one of the left and right sides at a lower side of the load bar; the locking member is pivotally supported vertically swingably at the lower side of the load bar and comprises a distal nail portion fitting into between the hook member and the load bar and holding the hook member in the disengaged posture only when the hook member is in the disengaged posture, a plumb bob portion extending from the pivotal support position of the locking member to the opposite side of the distal nail portion side, and a switching purpose operated portion protruding to the other of the left and right sides at the lower side of the load bar; the first switching means is composed of a cam rail acting upon the switching purpose operated portion of the hook member; and the second switching means is composed of a cam rail acting upon the switching purpose operated portion of the locking member.

4. The friction drive trolley conveyor according to claim 1, wherein the holding means of the hook member comprises two engaged depression portions provided around the pivotal support position of the hook member and a spring-urged lock member fitting one of the two engaged depression portions when the hook member is in the engaged posture and fitting the other when in the disengaged posture.

5. The friction drive trolley conveyor according to claim 4, wherein the hook member is provided with a switching purpose operated portion protruding in the lateral direction at the lower side of the load bar; and the first and second switching means are composed of cam rails acting upon the switching purpose operated portion.

6. The friction drive trolley conveyor according to claim 1, wherein the load bar is configured such that end surfaces of load bars of front and rear conveying traveling bodies can abut against each other when the hook member is in the disengaged posture.

7. The friction drive trolley conveyor according to claim 1, wherein front and rear end surfaces of the load bar are formed into such a shape that a clearance produced between the load bars of the front and rear conveying traveling bodies when the front side conveying traveling body traction-drives the rear side conveying traveling body via the traction purpose engaging means does not penetrate in the vertical direction in plan view.

8. The friction drive trolley conveyor according to claim 7, wherein the front and rear end surfaces of the load bar are formed into an inclined plane slanting in the same direction.

* * * * *